United States Patent [19]

Connolly et al.

[11] Patent Number: 4,840,728

[45] Date of Patent: Jun. 20, 1989

[54] VIBRATING SCREENING APPARATUS

[75] Inventors: James D. Connolly; Darrel Huff, both of Princeton, W. Va.

[73] Assignee: Conn-Weld Industries, Inc., Princeton, W. Va.

[21] Appl. No.: 167,636

[22] Filed: Mar. 14, 1988

[51] Int. Cl.[4] ..... B07B 1/46

[52] U.S. Cl. ..... 209/405; 209/409; 209/397

[58] Field of Search ..... 209/366.5, 395, 399, 209/403, 405, 409, 412, 414, 315, 319

[56] References Cited

U.S. PATENT DOCUMENTS

| | | | |
|---|---|---|---|
| 1,721,802 | 7/1929 | Baldwin et al. | 209/403 X |
| 1,725,511 | 8/1929 | Flanagan | 209/403 X |
| 2,090,767 | 8/1937 | Sayers et al. | 209/403 X |
| 2,208,596 | 7/1940 | Parks | 209/315 X |
| 2,456,075 | 12/1948 | Newhouse | 209/403 X |
| 3,865,720 | 2/1975 | Wilson | 209/409 X |
| 3,905,897 | 9/1975 | Jacobson | 209/405 |
| 4,444,656 | 4/1984 | Nelson et al. | 209/347 |
| 4,529,510 | 7/1985 | Johnson et al. | 209/405 X |
| 4,732,670 | 3/1988 | Nelson | 209/403 X |

FOREIGN PATENT DOCUMENTS

| | | | |
|---|---|---|---|
| 908425 | 3/1982 | U.S.S.R. | 209/412 |

*Primary Examiner*—Robert B. Reeves
*Assistant Examiner*—Gary C. Hoge
*Attorney, Agent, or Firm*—Wilmer Mechlin

[57] ABSTRACT

Vibrating screening apparatus in which one or more screen panels are supported between spring-mounted side plates on crosstubes and the several parts of the apparatus are connected primarily by bolting, the crosstubes by U-bolt and tube saddle clamps to framing for attaching the screen panels to the apparatus, the bolted connections by avoiding initial and residual stress and yielding as needed to operational stress imposed by vibrating mechanism of the apparatus, not only enabling the apparatus to operate for extended periods without fracture of parts but, should a fracture occur, permitting and facilitating selective removal of the fractured part for repair or replacement.

11 Claims, 4 Drawing Sheets

VIBRATING SCREENING APPARATUS

BACKGROUND OF THE INVENTION

Prior vibrating screening apparatus, whether inclined or, as disclosed in the U.S. Pats. to Jacobson No. 3,905,897 ('897) and Johnson et al No. 4,632,751 ('751), horizontal, customarily has a frame forward of transversely spaced spring-mounted side frames connected by cross-members and has between the side frames either one or a plurality of parallel vertically spaced decks or beds for mounting woven or, now more usually, wedge or profile wire screens. The apparatus also includes vibrating mechanism, which at least in the horizontal type, ordinarily is mounted on the frame above the screen decks, as in Jacobson. Also, as in Jacobson, the cross-members may be crosstubes welded at their ends to end plates and bolted through the end plates to the side plates.

A problem with prior vibrating screening apparatus is that even when, as in Jacobson, the crosstubes are bolted to the side plates and support the screen decks, the longitudinally extending elements or members of the decks intermediate the side frames are welded at intersections to the crosstubes. Not only is relief of their residual stress practically impossible but the welds are not adapted to yield without fracture to the flexing of crosstubes in response to the flexing of the side frames on their springs under the forces applied by the counterweighted vibrating mechanism.

Consequent upon dependence on welds for connecting vital parts, prior vibrating screening apparatus not only are prone to parts fracture but repair or replacement of a fractured part is at least a difficult and often an impossible task. The concern of the present invention is in vibrating screening apparatus to drastically reduce the likelihood of parts fracture and permit and facilitate repair or replacement of individual parts.

SUMMARY OF THE OBJECT

The primary object of the present invention is to provide improved vibrating screening apparatus wherein the several parts are connected primarily by bolting for enabling the connected parts to yield without fracture to vibratory forces imposed in service.

Another object of the invention is to provide improved vibrating screening apparatus whereof cross-members are bolted to side plates and are connected by bolting to parts of a screen deck supported thereon.

An additional object of the invention is to provide vibrating screening apparatus of the character described in the immediately preceding object, wherein the cross-members are crosstubes and the bolting connecting the crosstubes to the screen panels include U-bolt and saddle means clamped to the crosstubes.

Another object of the invention is to provide improved vibrating screening apparatus whereof longitudinally extending laterally spaced spring-mounted side plates are connected by a plurality of crosstubes each having end plates welded to opposite ends for bolting therethrough to the side plates, and spacer plates inserted between the end plates and side plates and bolted with the end plates to the side plates enable a crosstube to be unbolted and removed for repair or replacement without unbolting other crosstubes from the side plates.

A further object of the invention is to provide horizontal vibrating screening apparatus whereof screen panel support decking includes a plurality of crosstubes extending between and bolted to longitudinally extending spring-mounted side plates, the crosstubes are connected by U-bolts and saddles to longitudinally extending parts of said decking supported thereon and directly supporting any screen panels.

Another object of the invention is to provide vibrating screening apparatus of the character described in the immediately preceding object, whereof vibrating mechanisms is bolted at substantially the center of gravity of the apparatus to a forwardly inclined support beam spaced above the screen decking and bolted to and between the side plates.

The forgoing and other objects and advantages of the invention will appear hereinafter in the detailed description, be particularly pointed out in the appended claims, and be illustrated in the accompanying drawings in which:

FIGURE DESCRIPTION

DETAILED DESCRIPTION

Figure 1:
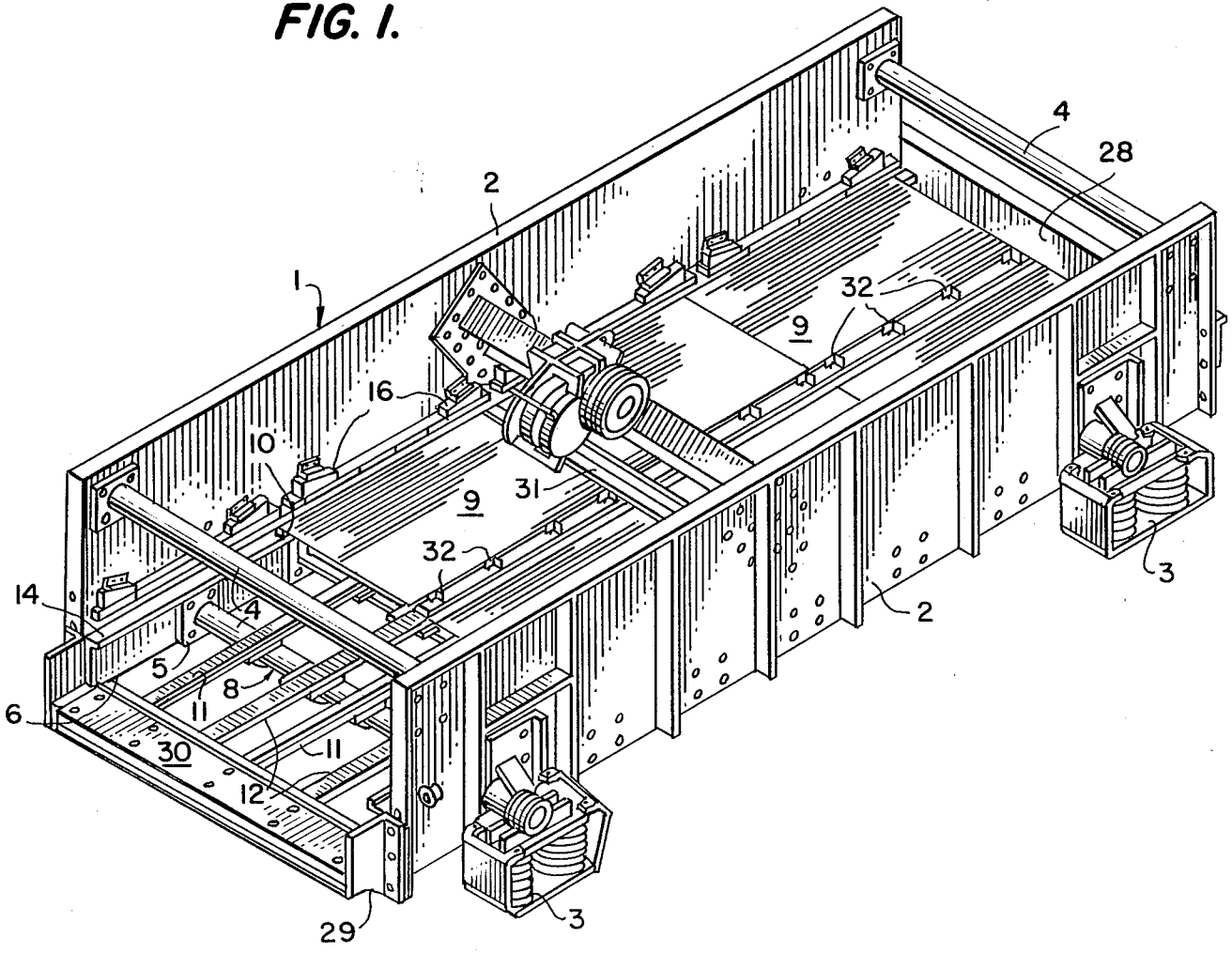
FIG. 1 is an isometric view of a preferred embodiment of the improved vibrating screening apparatus of the present invention with screen paneling removed from the front section to more clearly show certain of the details of construction.
Figure 2:
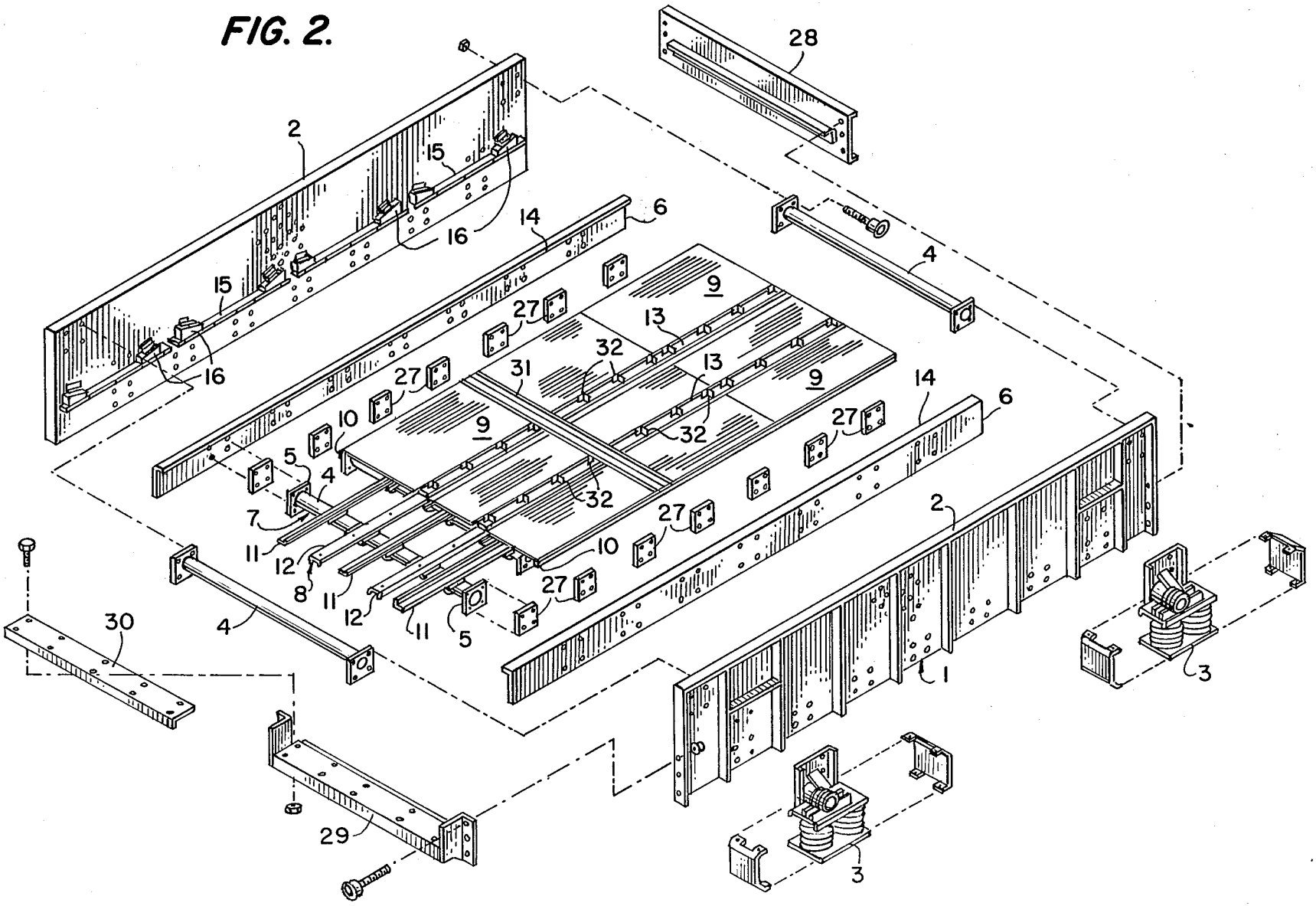
FIG. 2 is an exploded view of the apparatus of FIG. 1.
Figure 3:
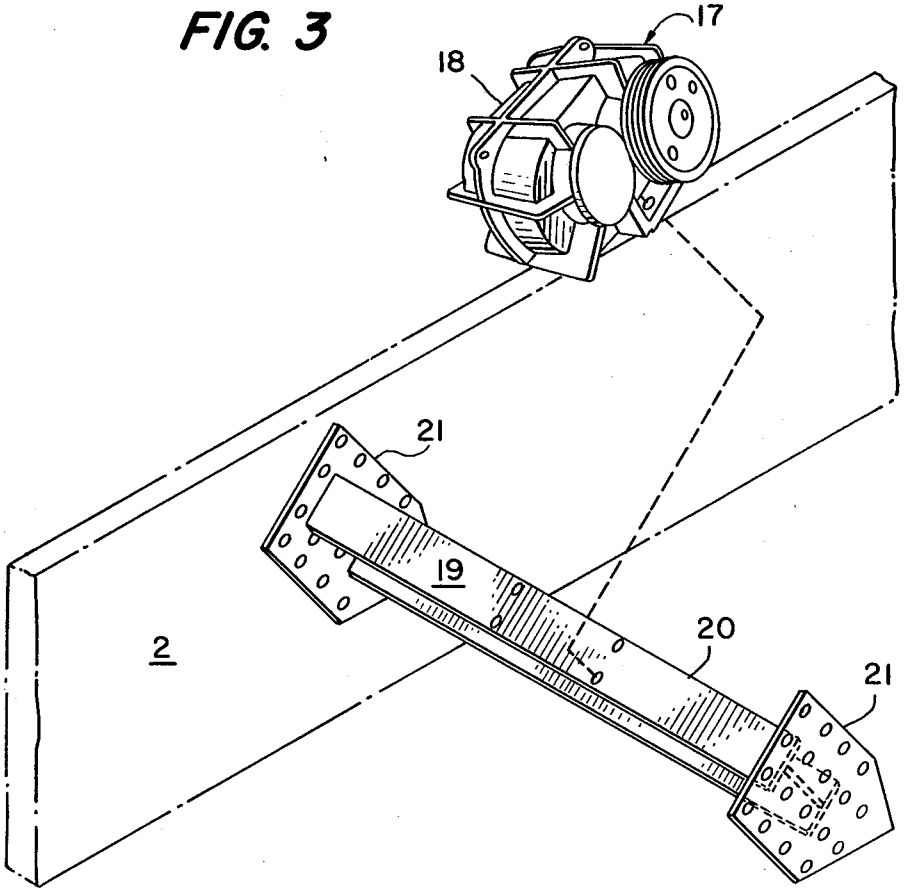
FIG. 3 is a fragmentary exploded view on enlarged scale showing the matter in which the vibrating mechanism is mounted on the apparatus.
Figure 4:
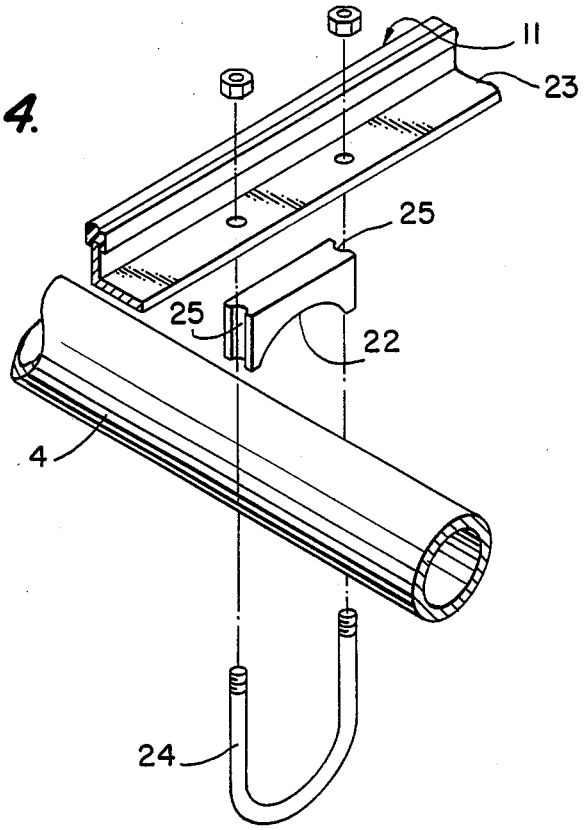
FIG. 4 is a fragmentary exploded view on a still larger scale showing a connection of a bucker bar to a crosstube.
Figure 5:
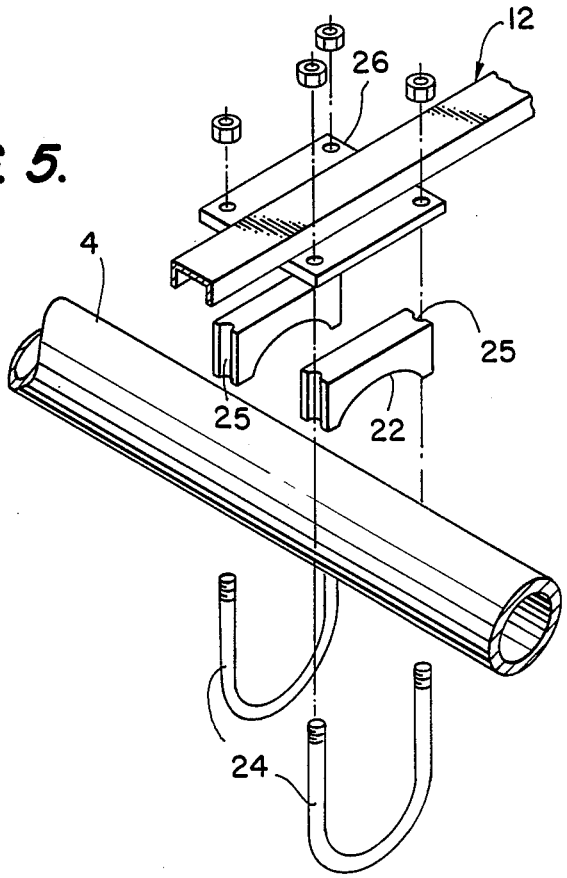
FIG. 5 is a fragmentary exploded view on the scale of FIG. 4, showing a connection of a bridge rail and clamping plate to a crosstube.

Referring now in detail to the drawings in which like reference characters designate like parts. the improved vibrating screening apparatus of the present invention, while adaptable for either horizontal or inclined vibrating screening, has been illustrated as horizontal screening apparatus and will be so described as exemplary of the invention.

The illustrated vibrating screening apparatus is comprised of a frame 1 having a pair of parallel longitudinally extending, suitably rectangular side plates or frames 2, each mounted or supported adjacent opposite ends on floor-based coil or other suitable compression spring units 3. Extending transversely between and connecting the side plates 2 are a plurality of cross-members, suitably in the form of crosstubes or tubular members 4 having end plates 5 fixed, as by welding, to opposite ends through which they are bolted to the side plates. Each of the side plates 2 has on a lower portion of an inner side a substantially longitudinally coterminous angle iron or top-flanged support plate 6, that is integrated between end plates 5 of adjacent or contiguous crosstubes and bolted therewith to the side plate.

Except for individual members connecting the side plates adjacent upper corners, the crosstubes 4 are arranged or disposed in one or a plurality of vertically spaced rows 7 of parallel, preferably equally laterally spaced and, for the illustrated horizontal apparatus, coplanar crosstubes. In each row 7 the crosstubes 4 serve as the support elements or members of a screen deck or bed 8 for mounting, attaching or seating usually a plurality of wedge or profile wire, woven mesh, perforated plate or other screen panels 9 suitable for the intended screening. For protection and positioning, the panels 9 and particularly the preferred wedge wire type, are edged along their longitudinal edges by rubber strips or edgings 10.

For attaching screen panels 9 to a screen deck 8, the or each deck, besides the supporting crosstubes 4, includes a plurality of laterally or transversely spaced parts suitably extending the length of the apparatus parallel to the side plates 2, of which one is a rubber-capped bucker bar 11 engageable with a midpart of a panel 9 and another a bridge rail 12 for receiving or seating an inner edge of a panel or, as illustrated, contiguous edges of a plurality of panels mounted abreast or side-by-side. Thus, if, as in the exemplary embodiment, the screen deck 8 mounts a total of twelve screen panels 9, arranged four in tandem and three abreast, intermediate the side plates 2 the bucker bars 11 will alternate with the bridge rails 12 and there will be three of the former and two of the latter.

At inner edges intermediate or away from the side plates 2, the screen panels 9 are clamped to the bridge rials 12 by overlying or superposed clamp strips 13 bolted to the rails. So clamped at their inner edges, the screen panels 9 adjoining the side plates are supported or rest at their outer edges on inturned or instanding horizontal flanges 14 of the support plates 6 and are clamped thereto, each preferably by a substantially longitudinally coextensive edge block 15 and a pair of wedges 16, both, for screening liquid-solid mixtures, suitably wooden as liquid absorbent and thus swelling or expanding and increasing the clamping force on exposure to the liquid of the mixture. So clamped at their sides, the screen panels are supported and preferably tensioned by being bowed upwardly in the middle by the bucker bars 11.

Vibrating of the frame 1 of the apparatus on its supporting spring units 3 is the function of a vibrating mechanism 17 of the type conventionally journalling in a housing 18 weighted eccentrics or counterweights (not shown). Suitably centered on the frame 1 of the apparatus above the latter's center of gravity, the housing 18 conveniently is centered longitudinally on and bolted to a top flange 19 of a supporting I-beam 20 extending transversely between and disposed normal or at right angles to the side plates 2 and bolted thereto through end plates 21 to the I-beam's ends. Conveniently belt-driven by an electric motor (not shown) and mounted for rotation of its weighted eccentric about an axis normal to and substantially in a plane parallel to the side plates 2, the vibrating mechanism 17, by virtue its forward tilt at a suitable angle, such as 45 degrees, is adapted to oscillate or vibrate the frame 1 by a G- or gravity force resultant of its output centrifugal force, with a forward force component for moving the material being screened forwardly along the horizontal screen panels 9 of the illustrated embodiment.

As shown in Jacobson '897, it is not uncommon in vibrating screening apparatus to include as the support of a screen deck a row of crosstubes extending between and bolted to the apparatus' side plates or frames. However, again as in Jacobson, the prior practice in such apparatus has been to weld to the crosstubes the parts of the deck they support. This practice has been responsible for the high rate or parts fracture or breakage and consequent frequent shutdowns of prior vibrating screening apparatus. The faults not only are the residual stresses imposed by welding on welded parts in the areas of the welds at points where heating for stress relief is impractical or impossible, but also the service or operational stresses imposed on welded parts by flexing or oscillating of the apparatus' frame 1 on its springs 3 under the resultant of the centrifugal force produced by its vibrating mechanism, to which the rigid or stiff connection of a weld is incapable over time of yielding or accommodating. Also, prior vibrating screening apparatus in which at least the screen deck or decks are constructed as unitary weldments, are particularly vulnerable to shutdowns in requiring frequent replacement of decks rendered short-lived by corrosion when used for screening a corrosive liquid-solid mixture, such as a coal slurry.

In the improved vibrating screening apparatus of the present invention, the centrifugal force generated or produced by the preferably centrally positioned or mounted vibrating mechanism 17 and exerted longitudinally of the frame 1 substantially in a plane centered on and parallel to the side plates or frames 2, causes the side plates to oscillate or flex longitudinally about their centers. The immediate recipients of the force from the flexing or oscillating side plates 2 are the crosstubes 4, on which the resultant is flexing longitudinally or axially of themselves and transversely of the side plates 2. The ultimate recipients of the flexing of the side plates, are the longitudinally extending parts of the or each screen deck 8 supported by its row of crosstubes 4, on which parts the flexing is longitudinal parallel to the side plates 2.

While the improved apparatus does not depart from prior practice in welding end plates 5 and 21 respectively to the crosstubes 4 and the I-beam 20 supporting the vibrating mechanism 17, the welds are in or parallel to the planes of the side plates 2 and thus only minimally affected by the flexing of the latter. However, radical departure of the improved apparatus from prior practice is in the mounting or connection of the crosstubes 4 to the parts of the screen deck 8 supported by them, namely: the bucker bars 11 and bridge rails 12. Each of these parts is bolted to the crosstubes at each intersection therewith by tube or pipe clamps.

For the angle iron bucker bars 11, each tube or pipe clamp preferably is comprised of a tube or pipe saddle 22 on which a base or base flange 23 of the bar seats or rest and a yoke in the form of a U-bolt 24 straddling and, with the saddle, girdling or clamping the crosstube. Extending upwardly through end grooves 25 in the saddle, the U-bolt is bolted at ends to the bucker bars' base. For the bridge rails 12 the preferred clamp is comprised of a laterally spaced pair of saddles 22 and U-bolts 24, embracing or girdling a crosstube 4 and laterally bracketing a bridge rail and a clamping plate 26 interposed between the saddles and bridge rail and bolted to the ends of both U-bolts. Rather than being bolted, each bridge rail 12 is welded along edges to the associated clamping plates 26. Since longitudinally extending in the direction of flexing of the bridge rail, the edge welds are only minimally affected by the operational or service flexing of the rail. Also, if desired, any residual stress in the rail or plate can be relieved by heat treating a rail and its clamping plates as a unit before their installation in an apparatus.

In any event, in the improved apparatus the crosstubes are neither residually nor service stressed, the bolted connections thereto of deck parts they support being adapted to yield to service stresses and return to normal or initial condition when the stresses are removed. Another radical departure of the improved apparatus from prior practice is the inserting or interposing between each welded end plate 5 of each crosstube 4 and the joining side plate 2, of a spacer plate 27 that is bolted with the end plate to the side plate. Detached or released whenever the related crosstube 4 is unbolted, one or both of the spacer plates 27, on being slid from between the crosstube's end plates 5 and the side plates 2, afford suffient end or axial play of the unbolted crosstube for it to be removed without disturbing other crosstubes. Thus, even in connecting the crosstubes 4 to the side plates 2, an outstanding advantage of the bolted connections of the improved apparatus is that they enable a fractured or damaged part to be removed for repair or replacement with a minimum of downtime of the apparatus.

In addition to the other parts previously described, the preferred frame 1 includes at the back a back plate 28, and at the front a discharged lip 29 and lip liner 30, all bolted to adjoining parts. There also are optional inclusions, of which one is a cross-dam 31 extending across the screen panels 9 intermediate the ends of the frame 1 and serving, when installed, to retard flow along the screen panels of a slurry or other material being screened. If used, the or each cross-dam 31, depending on whether the improved apparatus is fitted with one or up to three screen decks 8, conveniently is bolted through clamp strips 13 to underlying bridge rails 12. The other disclosed option is a series of V-shaped baffles 32 attached, as by welding, to each clamp strip 13, for deflecting the material being screened around bolts bolting the strip to the underlying ridge rail 12.

As in prior vibrating screening apparatus, the stroke of the improved apparatus under force of the vibrating mechanism 17 is short, preferably on the order of ¼" to ½" (0.635 to 1.37 cm). The G-gravity force exerted by the mechanism 17, for a given counterweighting, will vary mainly with its frequency or rpm. As a general rule, followed in the improved apparatus, a force or acceleration on the order of 5 Gs is required for effectively separating a solid-liquid mixture, such as a coal slurry, into its components. To apply a G-force of that order or magnitude, the centrifugal force exerted by the vibrating mechanism 17 should be about 5 times the weight of the apparatus. Thus, for improved apparatus weighing about 20,000 lbs. (9,080 kgs.), the centrifugal force of the mechanism should be about 100,000 lbs. (45,000 kgs.). Of the improved apparatus, by far the heaviest parts are the side plates 2 and the other parts, even of maximum size, ordinarily will not weigh over about 220–250 lbs. (99,9–113.5 kgs.). The relatively light weight of the other parts, and the much longer service life of the heavy side plates, make it entirely practical in most cases to repair the improved apparatus in the field using hand or manual wrenches.

From the above detailed description it will be apparent that there has been provided an improved vibrating screening apparatus which, thanks to its primarily or mainly bolted construction and use as support for a screen deck of a plurality of crosstubes extending transversely between and bolted to side plates and having the crosstubes bolted to the parts they support, imposes no initial or residual stresses on bolted parts and enables the connections therebetween to yield or give to service or operating stresses without fracture of the bolted parts, while greatly facilitating repair or replacement of any part that in time does fail.

It should be understood that the described and disclosed embodiment is merely exemplary of the invention and that all modifications are intended to be included that do not depart from the spirit of the invention and the scope of the appended claims.

Having now described our invention, we claim:

1. In vibrating screening apparatus having vibrating and screening means, the improvement comprising a frame having laterally spaced side plates, a plurality of cross-members extending transversely between said side plates, each cross-member having end plates welded to opposite ends thereof and being boltable through said end plates to said side plates, and a rigid spacer plate inserted between an end plate of each cross-member and an adjoining side plate and boltable with said end plate to said side plate.

2. Vibrating screening apparatus according to claim 1, wherein the cross-members are crosstubes, and including longitudinally extending members between said side plates, said longitudinally extending members being supported on said crosstubes and forming therewith screen deck means, and means bolting said supported members to said crosstubes.

3. Vibrating screening apparatus according to claim 2, wherein the bolting means are U-bolt and saddle means girdling said crosstubes and bolted to said supported members.

4. In vibrating screening apparatus having vibrating means, the improvement comprising a pair of laterally spaced spring-mounted side plates, and screen deck means for mounting screen panels between said side plates, said deck means including a plurality of crosstube means having end plate means fixed to opposite ends and extending transversely between and bolted through said end plate means to said side plates, spacer means spacing said end plate means from and boltable therewith to said side plates, and longitudinally extending means between and spaced laterally from said side plates and supported on and bolted to said crosstube means.

5. Vibrating screening apparatus according to claim 4, wherein said longitudinally extending means are laterally spaced bucker bar and bridge rail means for respectively upwardly bowing a screen panel intermediate longitudinal edges thereof and clamping inner of said edges, and the apparatus includes a support plate longitudinally coextensive with and bolted to an inside of each side plate and presenting an inturned flange for seating an outer longitudinal edge of a screen panel adjoining said side plate.

6. In vibrating screening apparatus "having vibrating and screening means", the improvement comprising laterally spaced longitudinally extending spring-mounted side plates, a plurality of laterally spaced crosstubes each having end plates welded to opposite ends thereof, said crosstubes being bolted through said end plates to said side plates, and spacer means individually spacing said end plates from and boltable therewith to said side plates.

7. Vibrating screening apparatus according to claim 6, including members supported on certain of said crosstubes for mounting screen panel means, and means bolting said supported members to said certain crosstubes, said bolting means comprising U-bolt and saddle means girdling said crosstubes and bolted to said supported members.

8. Vibrating screening apparatus according to claim 4, including U-bolt and saddle means girdling said crosstube means for bolting thereto said longitudinally extending means.

9. Vibrating screening apparatus according to claim 4, wherein the longitudinally extending means include laterally spaced bridge rail and bucker bar means, and means for bolting said bridge rail means to said crosstube means at each intersection therewith, said bolting means including a pair of spaced U-bolt and saddle means girdling said crosstube, a clamping plate seated on said saddle means and clamped by said U-bolt means to said crosstube means, and weld means welding said bridge rail means at longitudinally extending edges to said clamping plate.

10. Vibrating screening apparatus according to claim 9, wherein the bridge rail means are downwardly opening channel irons, the bucker bars are rubber-capped angle irons bolted at each intersection therewith to a crosstube, and the means for bolting the angle irons to each crosstube are a U-bolt and saddle together girdling the crosstube and respectively bolted to and seating a base of the angle iron.

11. Vibrating screening apparatus comprising a pair of transversely spaced longitudinally extending side plates each spring-mounted adjacent opposite ends, vertically spaced rows of coplanar laterally spaced crosstubes extending transversely between and bolted through end plates fixed to opposite ends thereof to said side plates, spacer plates spacing said end plates from and boltable therewith to said side plates, a plurality of laterally spaced longitudinally extending members between and spaced from the side plates, said members being supported on and bolted to the crosstubes of each row and forming therewith a screen deck for mounting screen panels, a forwardly tilted beam substantially centered longitudinally on and extending transversely between and bolted to said side plates, and a correspondingly tilted vibrating mechanism substantially centered longitudinally on and bolted to said beam for vibrating the mechanism.

* * * * *